US006216088B1

(12) United States Patent
Schulz et al.

(10) Patent No.: US 6,216,088 B1
(45) Date of Patent: Apr. 10, 2001

(54) METHOD FOR DETERMINING ITINERARY DATA

(75) Inventors: Werner Schulz, Meerbusch; Christel Sievers, Krefeld; Uwe Albrecht, Münhen; Karlheinz Schlottbom, Ratingen, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/308,857

(22) PCT Filed: Nov. 26, 1997

(86) PCT No.: PCT/DE97/02819

§ 371 Date: May 26, 1999

§ 102(e) Date: May 26, 1999

(87) PCT Pub. No.: WO98/24080

PCT Pub. Date: Jun. 4, 1998

(30) Foreign Application Priority Data

Nov. 27, 1996 (DE) ..... 196 50 844

(51) Int. Cl.[7] ..... G08G 1/09; G08G 1/0968

(52) U.S. Cl. ..... 701/209; 701/117; 701/200; 701/207; 701/208

(58) Field of Search ..... 701/200, 207, 701/208–213, 117–119

(56) References Cited

U.S. PATENT DOCUMENTS 4,390,951 * 6/1983 Marcy ..... 701/117

FOREIGN PATENT DOCUMENTS

WO 96/29688 * 9/1996 (WO) ..... G08G/1/0967

OTHER PUBLICATIONS

"Ein Beitrag zur wissenbasierten Modellierung von Entscheidungsprozessen in Verkehrsleit—und Verkehrsinformationssystemen," by Kamen Danowski; "Automatisierungstechnische Praxis—ATP," vol. 35, No. 12, Dec. 01, 1993; pp. 677–682.*

* cited by examiner

*Primary Examiner*—Bernarr E. Gregory
(74) *Attorney, Agent, or Firm*—Cohen, Pontani, Lieberman & Pavane

(57) ABSTRACT

A method for determing travel route data, especially within the framework of navigation of a vehicle, using a digital map which is kept in a central control station and in which static and dynamic parameters are stored by route section for the detected traffic routes, wherein the static parameters include at least structural features of the respective traffic route. The dynamic parameters include at least one conductance value and one load function of the respective section of the traffic route. The dynamic parameters are derived one time for the presetting of starting values from the structural features and, from that point, are continuously adapted to the real conditions of the respective sections of the traffic route with ensured availability of dynamic data independent from static parameters. The travel route data are determined on the basis of the relevant dynamic parameters.

20 Claims, No Drawings

METHOD FOR DETERMINING ITINERARY DATA

BACKGROUND OF THE INVENTION

1. Field of the Invention

The invention relates to a method for determining travel route data.

2. Discussion of the Prior Art

Methods for determining travel route data, especially within the framework of destination guidance or navigation of a vehicle, are known in principle and have been described in detail, for example, in W/O 89/02142. In this respect, in particular, traffic routes are maintained in a central control station by segment in a digital map, especially in a digital street map, wherein every segment represents a traffic route between two nodes, which can be intersections, junctions or the like, and is described by static or dymamic parameters. The static parameters essentially consist of structual features of the traffic route such as the type of road condition, or state of the road, number of lanes, speed limit and attributes such as curvy, steep ascents and descents. Moreover, it is known to asign stationary sensors to every segment, wherein dynamic parameters such as the quality of vehicles passing a segment per unit of time and their speed are detached by these sensors.

Further, it is known from German reference DE 195 25 291 to receive dynamic traffic data by means of appropriately outfitted test vehicles and to transmit this dynamic traffic data to a central control station.

Further, the dynamic parameters can be supplemented by weather information and temporary restrictions such as construction sites.

Prognoses about future traffic conditions in every segment which form the basis for the navigation of vehicles are derived in a known manner from the static and dynamic data collected in the control station by means of fundamental diagrams.

However, prognoses achieved in this way have the drawback that while a necessary travel time can be determined through a determined navigation along a plurality of segments based on the actual and prognosticated traffic data available in the control station, the navigated vehicle remains bound to the predetermined routing even when unforeseeable, obstructive events occur.

Further, every prognosis based on fundamental data is still inexact because, on principle, up-to-date dynamic parameters are left out of consideration. This effect is amplified in that analytically obtained mathematical relationships between the fundamental data are very complex and therefore very time-consuming with respect to computer processing.

SUMMARY AND DESCRIPTION OF THE INVENTION

Therefore, it is the object of the present invention to provide a method of the generic type mentioned above which can take into account current dynamic parameters and which can nevertheless be managed by simple computational techniques. It will be suitable not only for planning travel routes and for navigation of vehicles along planned travel routes, but can also be used for prognostic activities such as traffic route planning or for evaluating planned travel routes (determining the projected travel time).

Pursuant to this object, and others which will become apparent hereafter, one aspect of the present invention resides in a method for determining travel data in which static and dynamic parameters are stored in a digital map by route section for detected traffic routes. The static parameters include at least structural features of a respective traffic route. The dynamic parameters include at least one guide value and one load function of a respective section of the traffic route. The method further includes deriving the dynamic parameters one time for presetting starting values from the structural features and, from that point on, continuously adapting dynamic parameters to real conditions of the respective sections of the traffic route with ensured availability of dynamic data independent from static parameters. Finally, the travel route data is determined based on the relevant dynamic parameters.

For this purpose, current dynamic data (especially the current possible or average speed in a route section) are preferably obtained by measurements which are received by means of measuring devices arranged in vehicles, wherein the vehicles float along in traffic (floating cars). Also, data from measuring devices installed along the side of the road can be additionally used.

In this way, highly current traffic data are advantageously achieved and the navigation of vehicles built upon this traffic data can be adapted more quickly to the actual traffic data. That means that the reaction time from the occurrence of a traffic-obstructing event, through its detection, to the distribution of navigation information to vehicles moving toward the traffic obstructions is minimal.

Further, there is no processing of highly complex mathematical simulation calculations with predeterminable models based on fundamental data, as they are called, which essentially rely on assumptions relating to structural, i.e., static, parameters which seriously delay reaction time. Rather, through the preferred measurement at the driving object, not only is the specific location of the traffic-obstructing event known, but an obvious cause for the traffic obstruction can also be derived in the same traffic route through multiple measurements with different vehicles outfitted with measuring devices. Both sets of facts make it possible, for example, to respond immediately to the traffic-obstructing event by means of a navigation of vehicles which takes into account the traffic obstruction. Planned travel routes can be realistically evaluated, that is, in particular, relatively dependable predictions can be made about the anticipated travel time, wherein data extrapolated on the basis of current traffic data and/or data taken from an empirical database can be used as input data. The method according to the invention can be put to very good use for purposes of a simulation model, for example, in order to make traffic prognoses for traffic route planning.

The invention will be explained more fully hereinafter with reference to embodiment examples. The invention starts with a digital map which is kept in a central control station and in which static and dynamic parameters are stored for the detected traffic routes. For this purpose, the static parameters include at least structural features of the individual traffic routes such as number of traffic lanes, ascending and descending grades and type of road. It is characteristic for the invention that the travel route data are determined on the basis of the relevant dynamic parameters, wherein the dynamic parameters are derived one time for the presetting of starting values from the structural features and, from that point, are continuously adapted to the real conditions of the respective sections of the traffic routes with ensured availability of dynamic data independent from static parameters.

The dynamic parameters include at least one conductance value and one load function of the respective traffic route (i.e., of the specific section of road under consideration). The conductance value represents a measure for the possible speed in the selected traffic route and is preferably formed from the average speed of the vehicle in the respective route section. Off course, alternative forms of representation such as average time traveled, time per km, or the like, lie within the scope of the invention.

The load, for example, the number of vehicles on the section of a traffic route being considered, will influence the possible speed. The dependence of the conductance value on load is represented by a load function. As a rule, the conductance value will drop as the load increases. Both the conductance value and load have upper limits which are determined by the maximum possible speed or maximum allowed speed and by the maximum capacity which is defined, for example, by the number of traffic lanes. The load function is the essential classification feature of a traffic route, for example, within the framework of the navigation of vehicles according to the invention, since it determines the relevant criterion—the guide value—for a determined traffic route from the current load. The load data can come from current information as well as from extrapolated or simulated data or from an empirical database, so that, in particular, prognoses about future traffic developments are possible. Future conductance values can also be determined, for example, in order to prognosticate travel times for a certain planned travel route. In contrast to conventional methods for determining travel routes, in which purely descriptive parameters are used for characterizing route sections that remain unchanged within an updating time interval, a constantly dynamic description of the traffic situation is achieved through the use of a load function.

In practical execution, the load function is advisably described as an approximation function. For this purpose, the parameters of the approximation function are assigned to the route sections in the digital map in a computer in the central control station. For parametrization of the load function, all pertinent interpolation processes such as straight line representation or polynomial representation, spline methods and the like are used.

The essential advantage of the method according to the invention consists in that the load function is not determined by formal structural features such as, e.g., the feature "highway". Indeed, the load function is defined one time in a first approach by standard presets, for example, for highways, rural roads, etc. However, depending on the availability of qualified information, the load function is refined individually. Accordingly, the dynamic parameters are adapted to relevant conditions of the respective route section. In addition to further formal information such as, for example, speed restrictions, descending grades or the like, it is provided above all that the actual load function is preferably learned automatically. Accordingly, after a corresponding learning phase, every traffic route receives an individual load function according to best empirical knowledge.

This learning of the load function is carried out, for example, by means of vehicles which are outfitted with measuring devices, move along the respective traffic route, receive data and send this data to the central control station for processing, as well as by means of additional stationary measuring devices, as the case may be.

The great usefulness of the invention will be explained using the example of a three-lane highway section. Let the load function be defined by a set of parameters of a relevant interpolation method. Based on the structural features (three lanes, no speed limit), a standard parameter set is adopted which can already contain a certain predifferentiation. Based on measurement data regarding the quantity of vehicles and speed, a fine tuning of these parameters is carried out, if required, after sufficient static testing. In every traffic situation, the load function makes it possible to derive information about the traffic situation in this route section based on little measurement data.

If this route section is reduced to a two-lane highway with speed restriction due to a construction site, the measurement values will very quickly contradict the assumed load function. If the construction site is known in the central station, the parameters of the load function can be manually converted in a corresponding manner. However, the permanent plausibility check with the measurement values also quickly leads to a correction of the load function for purposes of a self-teaching system without manual input given sufficiently large deviations, so that the current characteristics of the road section are correctly reproduced without having manually to keep up with additional attributes such as "construction site" or the like, because the compatibility test of the current traffic data with the current dynamic parameters would lead to appropriate adaptation given sufficiently large deviations.

It is further provided for navigation that the decision or recommendation about the traffic routes along which every vehicle is guided to the destination is made exclusively on the basis of the current dynamic parameters.

For example, if, contrary to all expectations, all of the vehicles outfitted with measuring devices show an appreciable reduction in speed in a no-parking segment on a traffic route which is a highway segment, it is probable that a backup has developed or is in the process of developing. This can be supposed with a high degree of certainty when, in addition, fixedly installed measuring devices in the respective route section also confirm a very low average speed or even an average speed of zero. Subsequent navigated vehicles which have not yet entered this traffic route can be warned of this event in order to avoid this segment. Advantageously, the point in time that the event is noticed is synchronous with the occurrence of the event.

In another embodiment of the invention, the dynamic parameters can be manually or automatically scaled in predeterminable closed geographic areas.

In this way, all clear changes in the load function can advantageously be adapted to expected values already before the occurrence or synchronous with the occurrence of an event and can accordingly be taken into account in the navigation of vehicles over the total distance without having to wait for the learning process.

This scaling can be applied in a particularly advantageous manner when events are known ahead of time, for example, when construction sites are set up on individual traffic routes and during weather changes relevant to traffic for areas of traffic routes. Moreover, the scaling can be predifferentiated, e.g., according to the day of the week, time of day and weather.

It may be advantageous in this case to store the dynamic parameters learned during a continually occurring event as a scenario in an event-oriented database of experiential data in the central control station and to load this data as current dynamic parameters (standard presets) when a comparable event occurs for the same affected traffic routes. Such events are, in particular, large-scale events such as fairs, the beginning or end of school holidays or regionally typical weather conditions.

Further, this feature of the invention can be advantageously applied in traffic simulation and traffic planning. For example, the effect of increasing the number of traffic lanes for a given traffic route can be directly simulated.

According to a further feature of the invention, it is provided in general or at least in the event of repeated temporarily restricted traffic flow on a traffic route to determine alternate traffic routes for avoiding the respective traffic route and to incorporate these alternate traffic routes in an alternative parameter which is assigned to the respective traffic route in the digital map, particularly the traffic route with a restricted traffic flow. In this connection, the alternative parameter advisably includes at least the number of alternate traffic routes and their quality and length (or length of detour as the case may be) for purposes of a parameter list.

For the navigation of vehicles, the quantity or existence of possible alternative routes is frequently a decisive evaluation criterion for a traffic route.

For many routes, there are only a few sensible alternatives which often lead over the same traffic routes. These neuralgic points can be river bridges or tunnels, for example. Since, for example, all of the traffic of a particular region which traverses a river moves over only a few bridges, the traffic situation on these bridges is decisive for evaluating very many routes. The evaluation of the possible and sensible alternatives to a traffic route is expressed by the alternative parameters. The significance of this alternative parameter will be explained below with reference to an example.

In a simple application, the alternative parameter is equated with the detour necessary for an alternative. The farther the detour over an alternative route, the greater the alternative parameter. This magnitude can be further refined by additional influencing variables such as quantity of alternative routes or capacity of alternative routes. The alternative parameter ultimately evaluates the traffic route as to whether or not it is worthwhile to seek out an alternative route. The higher the alternative parameter, the less worthwhile the effort for seeking an alternative.

The alternative parameter can be an average value for many possible routes. These routes can be generated, for example, through experience or also through suitable simulations. The advantage in using this classification feature consists in the drastic reduction in the necessary computing time for determining alternative routes.

Another possibility for generating this parameter is to evaluate the topology of the traffic network map used as a basis. Contiguous greater areas with developed traffic networks are identified by relevant methods. The border of these greater areas is only traversed by a few traffic connections. These accesses form the neuralgic paths which are distinguished by a high alternative parameter. Examples for this are large cities as well as regional densely populated areas.

In a further embodiment of the invention, consecutive traffic routes of a route with few branches are combined to form traffic route complexes and are taken into account for navigation as an individual traffic route and, depending on the degree of branching of the traffic flow at nodal points of successive traffic routes, a complexity parameter is assigned to each of the successive traffic routes.

Therefore, a long stretch of highway over flat land having few entrances and exits and, normally, scant traffic is defined, for example, by a low complexity parameter. Route sections with a constantly low complexity parameter can therefore be combined to form a great or master route section characterized essentially by straight driving wherein almost all traffic entering at one end exits again at the other end.

This classification feature can advantageously be used particularly in controlling the internal computing effort, in controlling the gathering of information, especially detection of the traffic situation, but also in displaying the relevant information.

The method according to the invention is advantageously used in the framework of a navigation system external to the vehicle in which a route recommendation is determined by a central station as travel route data, wherein the decision about the traffic routes along which the vehicle is to be guided in the framework of a route recommendation is made primarily or exclusively on the basis of the relevant dynamic parameters. The corresponding navigation information can be conveyed to the vehicle by means of cellular mobile radio, for example. But the method can also be used advantageously in an onboard navigation system in which route planning and readout of navigation information is carried out in an autarkic manner in the vehicle. In a system of this kind, it may be advisable, prior to or during travel, to send the planned route to the central office, to evaluate it according to currently existing relevant dynamic parameters and, if need be, to have it changed and the results transmitted back to the vehicle in order to carry out the navigation in an autarkic manner. During route planning, the evaluation of alternative route suggestions is advisably carried out with reference to the complexity parameter and, if need be, other criteria, especially driving time and driving distance.

What is claimed is:

1. A method for determining travel route data using a digital map which is kept in a central control station comprising the steps of:

measuring dynamic parameters for traffic routes;

storing static and the dynamic parameters in the digital map by route section for detected traffic routes, the static parameters including at least structural features of a respective traffic route, the dynamic parameters including at least one conductance value representing traffic flow and one load function representing capacity of a respective section of the traffic route;

deriving the dynamic parameters one time for presetting starting values from the structural features and, from that point, continuously adapting the dynamic parameters to real conditions of the respective sections of the traffic route with ensured availability of dynamic data independent from static parameters; and determining the travel route data based on relevant ones of the dynamic parameters.

2. A method according to claim 1, including forming the guide value from an average speed of vehicles in the respective section of the traffic route, the load function describing a dependence of the conductance value on a quantity of vehicles on the respective route section.

3. A method according to claim 1, including describing the load function as an approximation function and assigning parameters of the approximation function to each route section.

4. A method according to claim 3, wherein the step of describing the load function as an approximation function includes describing the load function in polynomial representation.

5. A method according to claim 1, wherein the step of determining travel route data includes determining travel route data containing a route recommendation, and further including making a decision about the traffic routes along which every vehicle is guided to a destination at least primarily on the basis of the relevant dynamic parameters.

6. A method according to claim 5, further including determining alternate traffic routes for avoiding the respective traffic route and incorporating the alternate routes in an alternative parameter which is assigned to the respective traffic route in the digital map.

7. A method according to claim 6, wherein the alternative parameter includes at least the number of alternate traffic routes and their quality and length for forming a parameter list.

8. A method according to claim 6, including determining the alternative parameter at least for traffic routes whose traffic flow has repeatedly been subject to temporary restrictions.

9. A method according to claim 5, further including combining consecutive traffic routes with few branches to form traffic route complexes and taking the route complexes into account for navigation as one traffic route, and, depending on the traffic route and degree of branching of traffic flow at nodal points of successive traffic routes, assigning a complexity parameter to each of the successive traffic routes.

10. A method according to claim 9, further including evaluating alternative route suggestions during route planning based on the complexity parameter.

11. A method according to claim 10, wherein the step of evaluating alternate route suggestions includes evaluating based on the complexity parameter and additional criteria.

12. A method according to claim 11, wherein the additional criteria are travel time and travel distance.

13. A method according to claim 1, including using respective current dynamic parameters as the relevant dynamic parameters.

14. A method according to claim 1, further including scaling the dynamic parameters in predeterminable closed geographic areas.

15. A method according to claim 14, wherein the scaling step includes scaling based on standard presets from an empirical database in case of weather changes affecting traffic and events known beforehand.

16. A method according to claim 15, including predifferentiating the scaling according to at least one of: day of week, time of day and weather.

17. A method according to claim 1, including adapting the dynamic parameters for purposes of a self-learning system, collecting current traffic data, checking compatibility of this data with the current dynamic parameters, and adapting the dynamic parameters where there are sufficiently large deviations.

18. A method according to claim 17, including gathering at least some of the traffic data by vehicles floating in the flow of traffic.

19. A method according to claim 18, wherein the step of gathering traffic data includes gathering up-to-date average speed in a route section.

20. A method according to claim 1, including one of deriving traffic prognoses on the basis of dynamic parameters for traffic route planning and prognosticating driving times for planned travel routes, and determining future guide values via the respective load function from load data which are one of extrapolated and taken from an empirical database.

* * * * *